US007231719B2

(12) United States Patent
Butcher

(10) Patent No.: US 7,231,719 B2
(45) Date of Patent: Jun. 19, 2007

(54) HAIR CLIPPER ACCESSORIES

(76) Inventor: Susie Butcher, 16127 CR 178, Tyler, TX (US) 75703-7058

( * ) Notice: Subject to any disclaimer, the term of this patent is extended or adjusted under 35 U.S.C. 154(b) by 303 days.

(21) Appl. No.: 10/228,858

(22) Filed: Aug. 27, 2002

(65) Prior Publication Data

US 2003/0037441 A1 Feb. 27, 2003

Related U.S. Application Data

(60) Provisional application No. 60/315,135, filed on Aug. 27, 2001.

(51) Int. Cl.
*B26B 19/22* (2006.01)

(52) U.S. Cl. ..... 30/196; 30/233

(58) Field of Classification Search ..... 30/233, 30/195–196, 323, 236
See application file for complete search history.

(56) References Cited

U.S. PATENT DOCUMENTS 4,622,745 A * 11/1986 Wahl ..... 30/201
4,719,702 A * 1/1988 Hoffman ..... 30/326
4,779,344 A * 10/1988 Panisch ..... 30/326
D310,944 S * 10/1990 Lutzker ..... D7/655
5,050,305 A * 9/1991 Baker et al. ..... 30/201
5,946,807 A * 9/1999 Crane et al. ..... 30/141
6,105,254 A * 8/2000 Crane et al. ..... 30/128
6,134,790 A * 10/2000 Watson ..... 30/326
6,659,476 B2 * 12/2003 Weida ..... 280/47.19
2002/0187756 A1 * 12/2002 Chen ..... 455/90

* cited by examiner

*Primary Examiner*—Kenneth E. Peterson
*Assistant Examiner*—Phong Nguyen

(57) ABSTRACT

The present invention achieves technical advantages as devices that attach to hair clippers, providing the clippers with an appearance that is preferably in harmony with the sound of clippers, and that is also non-threatening to a person, such as a child. In one embodiment, the invention includes a first plate configured to cover a top half of a pair of clippers, and a second plate configured to cover a bottom half of a pair of clippers where the plates together preferably provide an appearance of an airplane.

1 Claim, 6 Drawing Sheets

HAIR CLIPPER ACCESSORIES

RELATED APPLICATION AND CLAIM OF PRIORITY

The present invention is related to and claims priority from U.S. Provisional Patent Application No. 60/315,135 entitled Hair clipper and/or guard for children, by Susie Butcher, filed on Aug. 27, 2001.

TECHNICAL FIELD

The present invention relates to the field of hair care, and more particularly the invention relates to accessories for hair clippers.

STATEMENT OF A PROBLEM ADDRESSED BY THIS INVENTION

Interpretation Considerations

This section describes the technical field in more detail, and discusses problems encountered in the technical field. This section does not describe prior art as defined for purposes of anticipation or obviousness under 35 U.S.C. section 102 or 35 U.S.C. section 103. Thus, nothing stated in the Statement of a Problem Addressed by This Invention is to be construed as prior art.

Discussion

Almost everyone remembers the sensations they felt at their first haircut with clippers. The sight of the "large" machine being wielded by the barber, the loud buzzing sound, and the sight of hair falling everywhere are enough to strike fear in the heart and send a chill down the spine of almost anyone—especially children. Often, these sensations overwhelms a child's senses, and the child's natural instincts take over and their mind invokes the "fight or flight" survival instinct—often, the child literally fleas the barber's office in fear. In other instances, an animal, such as a dog or a horse, may flee or struggle with its groomer when the groomer tries to cut the animal's hair with clippers.

Of course, a clean-cut, well-groomed appearance is important for acceptance in society. In addition, growing up just plain requires that one overcome these types of fears. Also, animals that are less stressed provide more fun for their owners and caretakers. Furthermore, a financial benefit flows to those hair-cutters who use devices and methods that abate the fear of clippers and make the cutting of hair fun. Accordingly, there is a need for devices that reduce or eliminate the fear associated with a haircut.

SELECTED OVERVIEW OF SELECTED EMBODIMENTS

The present invention achieves technical advantages as devices that attach to hair clippers, providing the clippers with an appearance that is preferably in harmony with the sound of clippers, and that is also non-threatening to a person, such as a child. In one embodiment, the invention includes a first plate configured to cover a top half of a pair of clippers, and a second plate configured to cover a bottom half of a pair of clippers where the plates together preferably create provide an appearance of a thing that is in harmony with the sound of clippers. In a second embodiment, the invention provides a toy that is attached to the pair of clippers.

Of course, other features and embodiments of the invention will be apparent to those of ordinary skill in the art. After reading the specification, and the detailed description of the exemplary embodiment, these persons will recognize that similar results can be achieved in not dissimilar ways. Accordingly, the detailed description is provided as an example of the best mode of the invention, and it should be understood that the invention is not limited by the detailed description. Accordingly, the invention should be read as being limited only by the claims.

BRIEF DESCRIPTION OF THE DRAWINGS

Various aspects of the invention, as well as at least one embodiment, are better understood by reference to the following EXEMPLARY EMBODIMENT OF A BEST MODE. To better understand the invention, the EXEMPLARY EMBODIMENT OF A BEST MODE should be read in conjunction with the drawings in which.

AN EXEMPLARY EMBODIMENT OF A BEST MODE

Introduction

Figure 1:
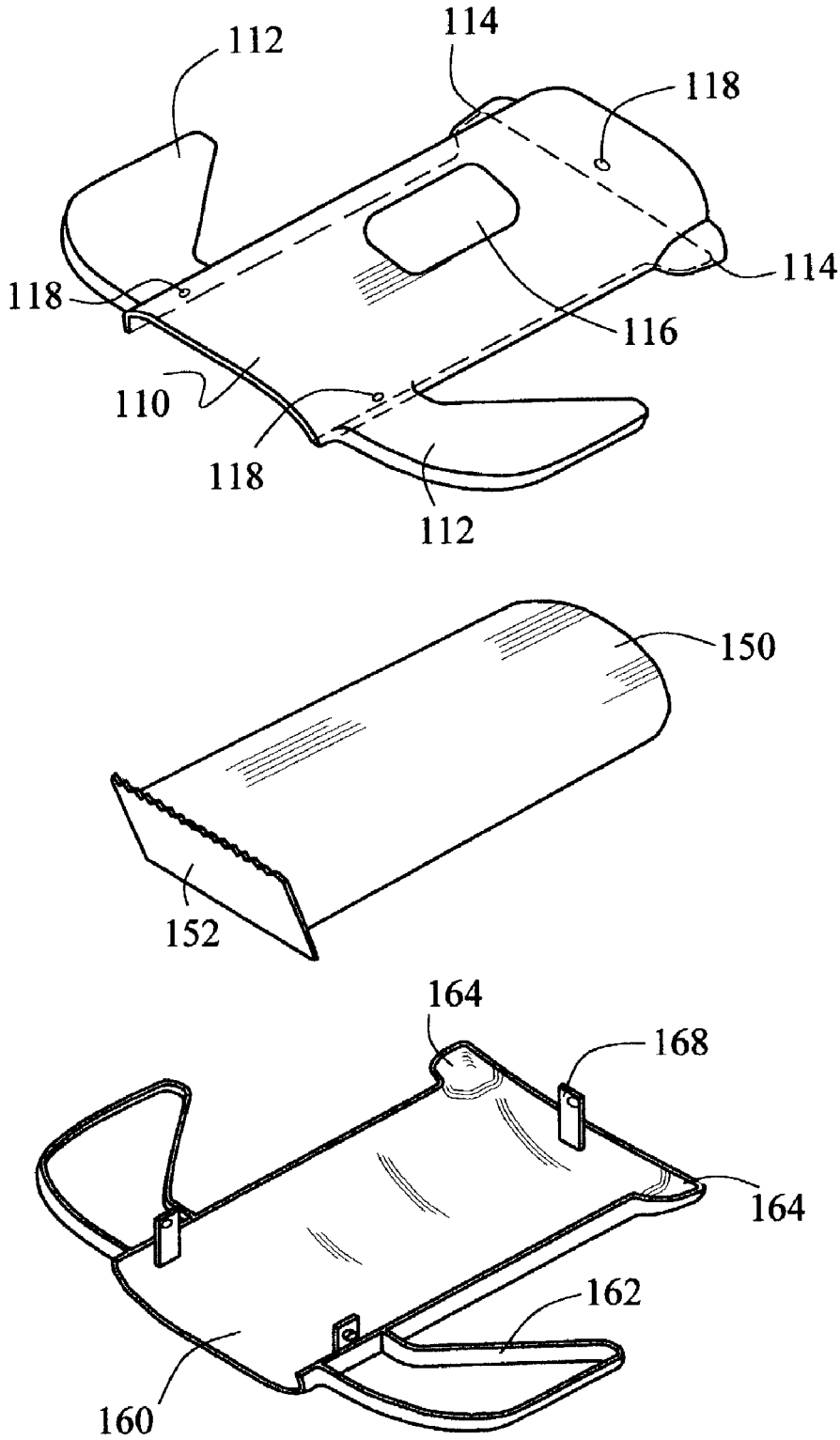
FIG. 1 illustrates an exploded view of one embodiment of the invention being shown about a pair of clippers.

The invention is a wrapping bag enabled to wrap items. The wrapping bag generally includes a bottom portion integrally formed with a top portion, the bottom portion enabled to enclose an item therein, and the top portion comprising at least two straps, the two straps capable of being tied together so as to close the bottom portion. An alternative embodiment provides a hole (or holes) in the bag so that straps may be pulled through the hole, thus sealing the bag and providing for additional features. The invention is also a method of using the wrapping bag.

Interpretation Considerations

When reading this section (An Exemplary Embodiment of a Best Mode, which describes an exemplary embodiment of the best mode of the invention, hereinafter "exemplary embodiment"), one should keep in mind several points. First, the following exemplary embodiment is what the inventor believes to be the best mode for practicing the invention at the time this patent was filed. Thus, since one of ordinary skill in the art may recognize from the following exemplary embodiment that substantially equivalent structures or substantially equivalent acts may be used to achieve the same results in exactly the same way, or to achieve the same results in a not dissimilar way, the following exemplary embodiment should not be interpreted as limiting the invention to one embodiment.

Likewise, individual aspects (sometimes called species) of the invention are provided as examples, and, accordingly, one of ordinary skill in the art may recognize from a following exemplary structure (or a following exemplary act) that a substantially equivalent structure or substantially equivalent act may be used to either achieve the same results in substantially the same way, or to achieve the same results in a not dissimilar way.

Accordingly, the discussion of a species (or a specific item) invokes the genus (the class of items) to which that species belongs as well as related species in that genus. Likewise, the recitation of a genus invokes the species known in the art. Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated (for example, one recognizes that "tacking" may be done by nailing, stapling, gluing, hot gunning, riveting, etc., and so a use of the word tacking invokes stapling, gluing, etc., and all other modes of that word and similar words, such as "attaching"). Fourth, unless explicitly stated otherwise, conjunctive words (such as "or", "and", "including", or "comprising" for example) should be interpreted in the inclusive, not the exclusive, sense. Fifth, the words "means" and "step" are provided to facilitate the reader's understanding of the invention and do not mean "means" or "step" as defined in § 112, paragraph 6 of 35 U.S.C., unless used as "means for—functioning—" or "step for—functioning—" in the claims section.

Discussion of the Figures

FIG. 1 illustrates an exploded view of one embodiment of the invention (also, the accessory) being shown about a pair of clippers 150 (also, the clippers 150). The clipper accessory generally comprises a shell configured to cover at least a portion of a pair of clippers. The shell may comprise one shell 110, and may include a second shell 160 for added support and/or added toy functionality. The shell 110 includes access points 116 that provide for user (barber or hair-cutter) access to various controls on the clippers 150. Accordingly, it is understood that the size and location of the access points 160 will vary depending on the type of clippers 150 that the accessory is designed to accommodate. In addition, the shell 110 has means for attaching the shell 110 to the second shell 160, preferably via a snapping mechanism comprising holes 118 and snaps 168, for example. Of course, there are numerous means of attachment that are readily apparent to those of ordinary skill in the art and these other means of attachment do not depart from the scope or spirit of the invention. In an alternative embodiment, the accessory comprises a single shell made of foam or other elastic material. It is appreciated that a foam shell provides a muffling effect to the sounds produced by clippers. Preferably, the alternative embodiment conforms to clippers 150 by slipping over the clippers, typically when the head 152 of the clippers is removed.

The shell 150 "camouflages" the clippers with an appearance that is less threatening to a child than clippers by appearing to be something that the child is familiar with and endears. Preferably, the accessory appears to be something that in reality makes a sound similar to, or suggestive of, the sound of clippers. For example, an animal such as a bear, lion, wildcat, or dog growls, and the growl is suggestive of the sound produced by clippers. Similarly, an airplane, car, truck, train, tank, or boat, for example, also make sounds that are suggestive of the sound produced by clippers. In FIG. 1, the accessory has the appearance of an airplane that is suggested by wings comprised of wing tops 112, and wing bottoms 162, and jet-blasts comprised of jet-blast tops 114 and jet-blast bottoms 164. Additional suggestive detail can be provided by painting the accessory, color-selecting the accessory, or by applying stickers having military or civil aviation markings to the accessory. Accordingly, the shell has the appearance of a toy, and may function as a toy by being removed from the clippers and being handed to a child.

Figure 2:
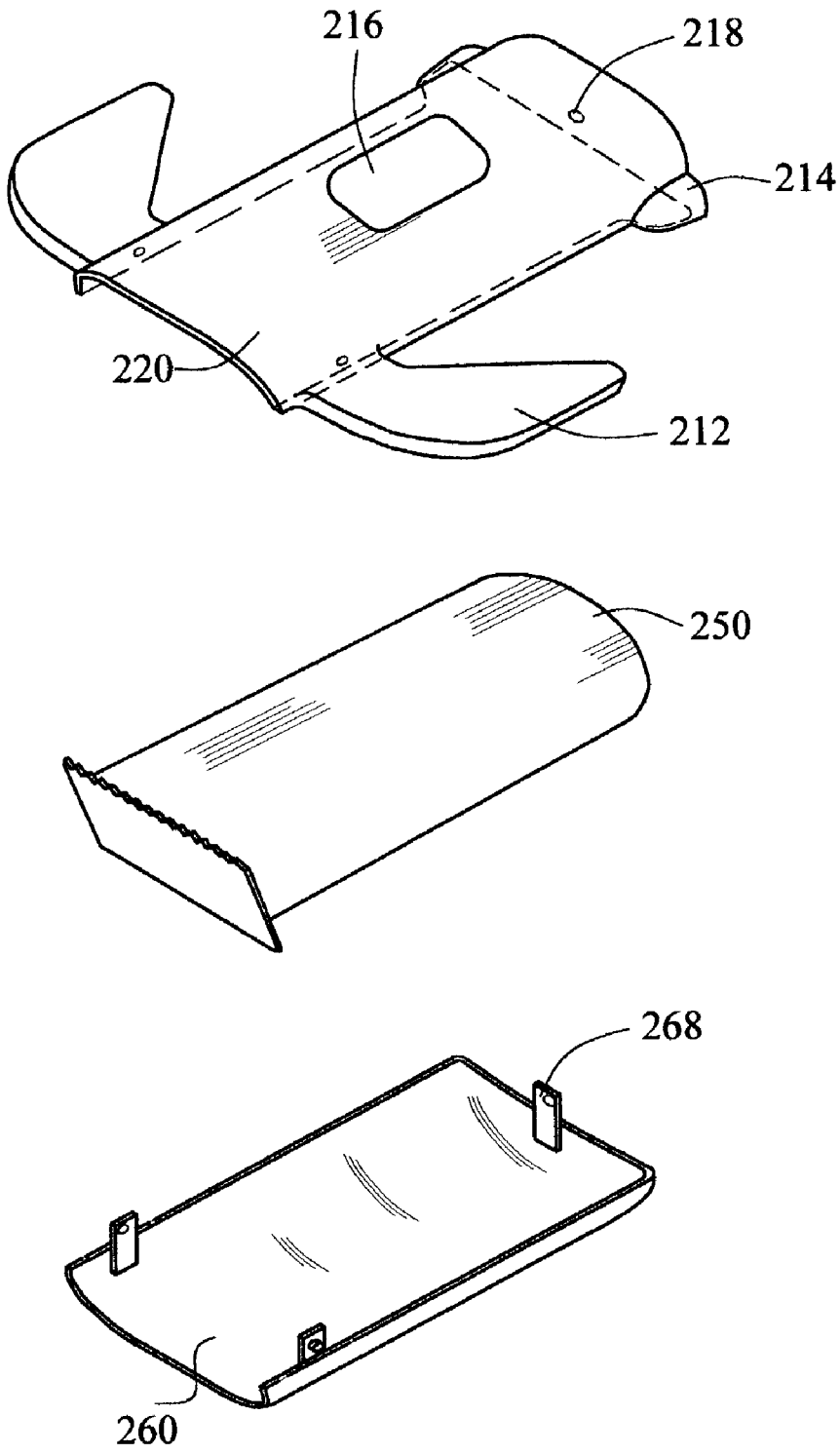
FIG. 2 provides an exploded view of a second alternative embodiment of the invention being shown about a pair of clippers.

FIG. 2 provides an exploded view of a second alternative embodiment of the invention being shown about a pair of clippers 250. In FIG. 2 a shell 220 maintains all of the visual attributes needed to identify the accessory as a particular toy. For example, the shell 220 has fully formed wings 212 and exhaust ports 214. In a preferred embodiment, the accessory is configured to attach to a second shell 260, preferably via snaps formed by snap holes 218 and snaps 268, for example. The second shell 260 is preferably neutral in appearance and may form a standard attachment for use with a plurality of shells.

Figure 3B:
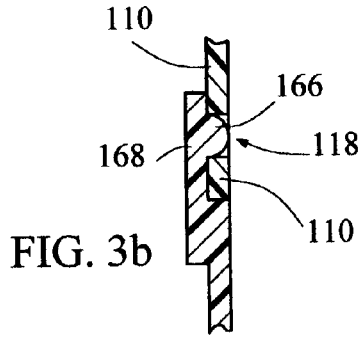
FIG. 3*b* is a close-up of the snap of FIG. 3 taken along lead lines A—A.
Figure 3A:
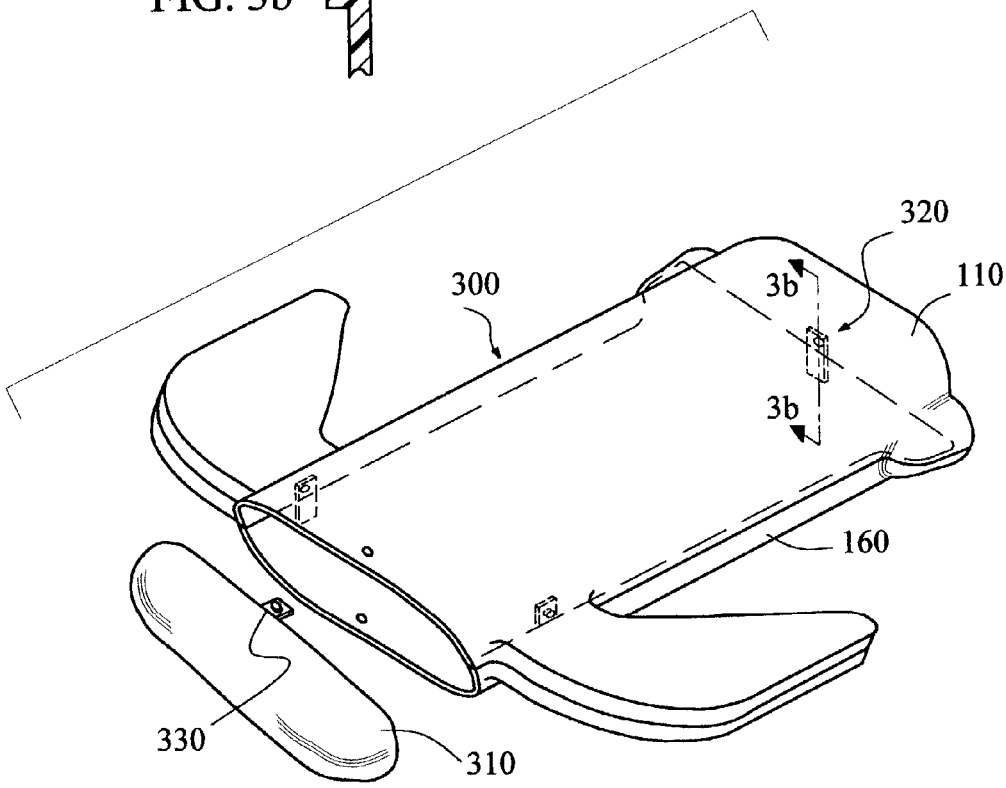
FIG. 3*a* shows the embodiment of FIG. 1 configured as a toy.

FIG. 3*a* shows the embodiment of FIG. 1 configured as a toy airplane. The accessory 300 includes a shell 110 and a second shell 160 coupled together via snaps 320. In addition, the accessory has a cap 310 that is attachable to at least one of the shells (preferably both) via a snap 330 so that the accessory 300 can function as a complete toy for a child following a haircut. FIG. 3*b* is a close-up of the snap of FIG. 3 taken along lead lines A—A. From FIG. 3*b* one can see that the shell 110 has a hole 118 into which a snap point 166 of a snap 168 may securely fit. Of course, there are many methods of attaching a cap such as that shown in FIG. 3 to an accessory such as the accessory 300, and these methods are readily known to those of ordinary skill in the art and are hereby incorporated in the invention. Thus, after a barber completes a haircut, the accessory may be removed from clippers and may then be put together to form a toy for a child.

Figure 4A:
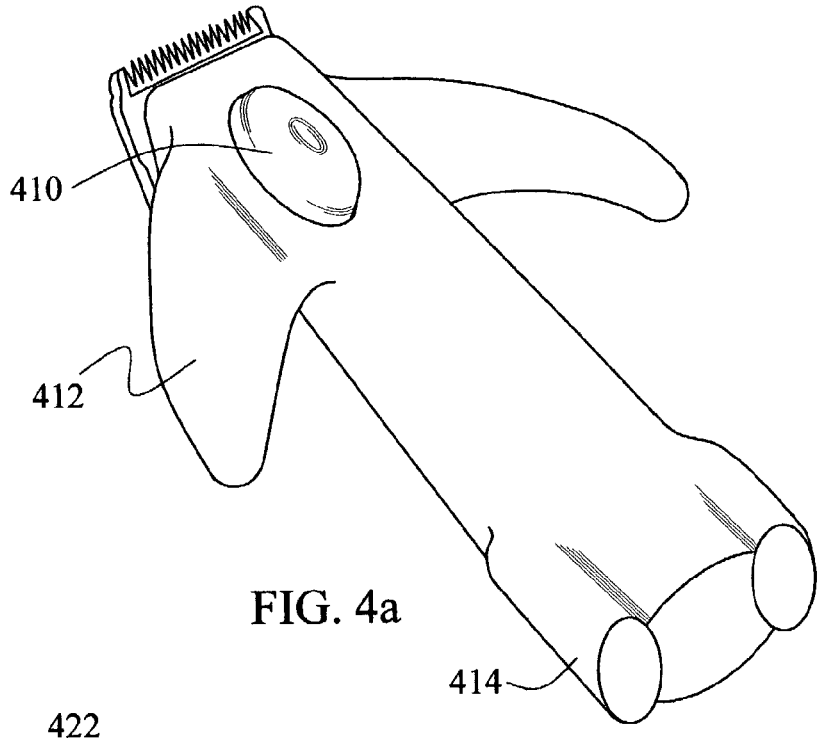
FIG. 4*a* illustrates an embodiment of the invention configured to appear as an airplane.
Figure 4B:
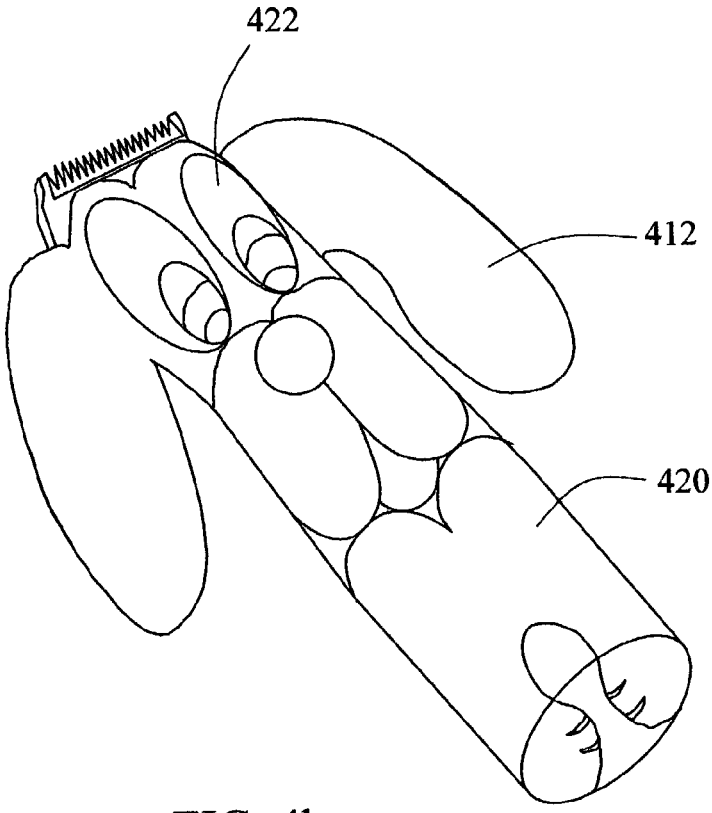
FIG. 4*b* illustrates an embodiment of the invention configured to appear as an animal (dog)

FIG. 4*a* illustrates an embodiment of the invention configured to appear as an airplane. The airplane is suggested by wings 412 and exhaust ports 414, while a cockpit is suggested by the on/off switch 410 of the clippers. Of course, the accessory-airplane can have its appearance enhanced with additional features and civil/military markings. Similarly, FIG. 4*b* illustrates an embodiment of the invention configured to appear as an animal (a dog).

Figure 5:
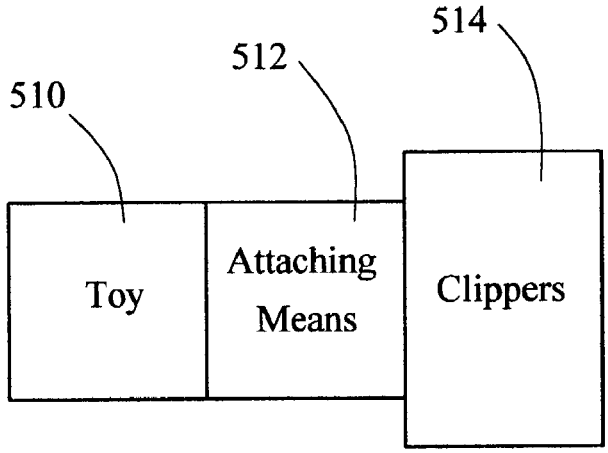
FIG. 5 is a block-diagram of the invention.
Figure 6A:
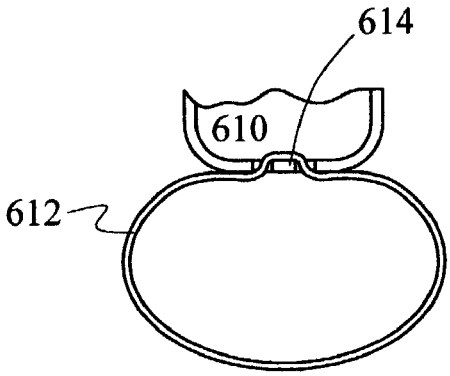
FIGS. 6*a*–6*d* shows selected alternative means for securing the invention to a pair of clippers.
Figure 6B:
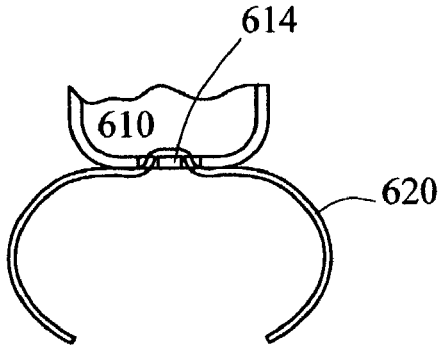
Figure 6C:
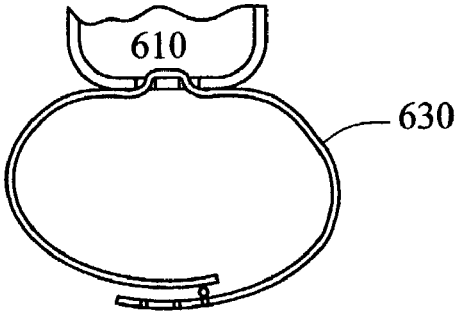
Figure 6D:
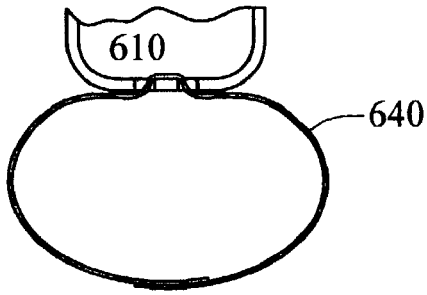

FIG. 5 is a block-diagram of an alternative embodiment of the invention as a clipper accessory. The clipper accessory 500 includes a toy 510, and a means for attaching (attaching means) 512 the toy 510 to clippers 514. The toy 510 may resemble an animal such as a bear or mouse, and may also resemble a machine such as an airplane or a car. The means for attaching 512 is any device for coupling the toy 510 to the clippers 514.

To provide exemplary embodiments of means for attaching 512, FIGS. 6*a*–6*d* show selected alternative means for attaching a toy 610 to a pair of clippers (not shown). For example, the means for attaching may be an elastic band 612, similar to a common ponytail hair-tie and is coupled to the toy 610 via a simple weave 614. An alternative means for attaching comprises a pair of Velcro™ straps 640, and could also be embodied as a clip 620 or a snap strap 630, for example. In all the embodiments illustrated in FIG. 6, the means for attaching are attached to the toy 610 with a weave-type connection 614. However, it should be understood that other types of connections are readily apparent to those of ordinary skill in the art, and are hereby incorporated into the invention.

Figure 7A:
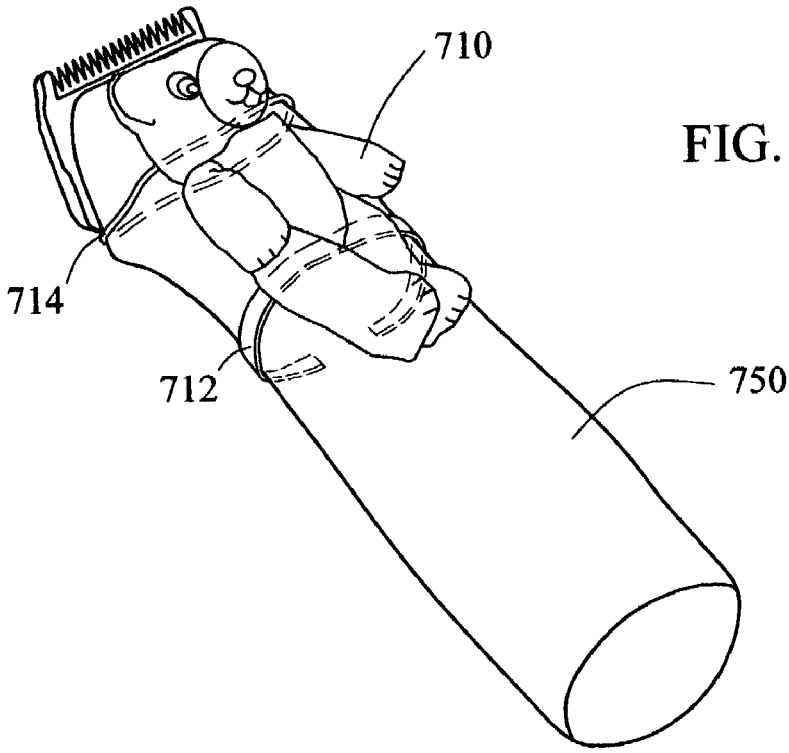
FIG. 7*a* illustrates an alternative embodiment of the invention as an animal (bear) strapped to a pair of clippers.
Figure 7B:
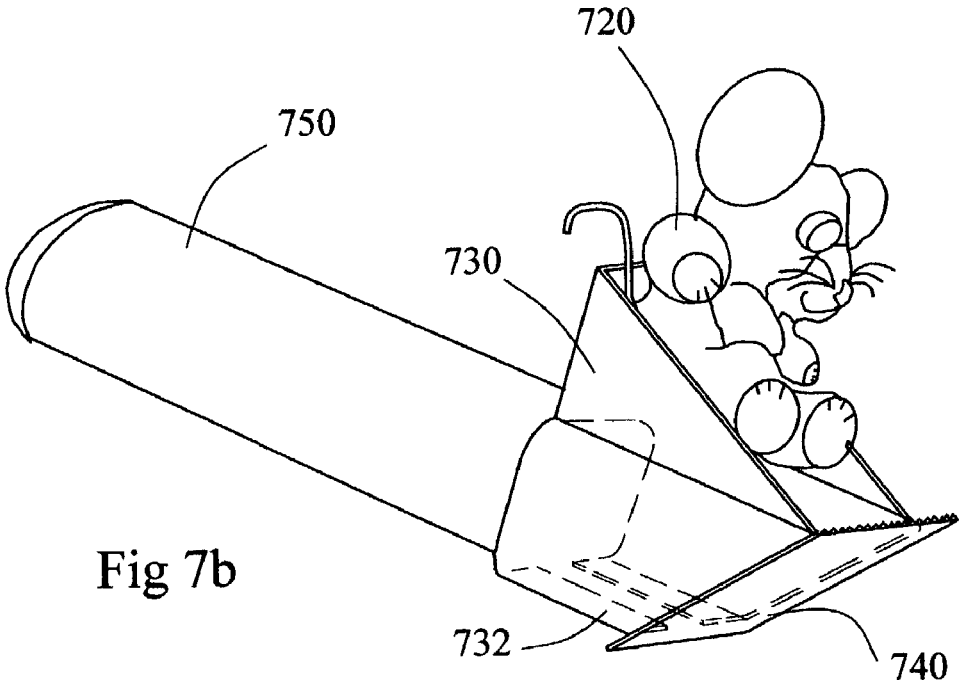
FIG. 7*b* provides an alternative embodiment of the invention as an animal (mouse) strapped to a pair of clippers.

Accordingly, the invention can be used to affix a toy to clippers. FIG. 7*a* illustrates an alternative embodiment of the invention as an animal (bear) 710 strapped to a pair of clippers 750 via attaching means 712, 714. Similarly, FIG. 7*b* provides an alternative embodiment of the invention as an animal (mouse) 720 strapped to a pair of clippers 750 via an attaching means 730. The attaching means 730 generally forms a seat for holding the toy 720. Of course, additional means can be provided for holding the toy 720 in the attaching means 730, such as Velcro, a snap, or a belt, for example (numerous other devices for securing a toy 720 in the attaching means 730 are readily apparent to those of ordinary skill in the art, and are hereby incorporated in the invention). In the present exemplary embodiment, the attaching means 730 is held to the clippers 750 via clamps 732 which are created to fit about a neck (not shown) and adjacent to the head 740 of the clippers 750.

Thus, in practice a barber can attach a toy to clippers prior to cutting hair. For sanitary reasons, and to promote goodwill with the child whose hair has just been cut, the toy can then be easily removed and provided to the child after the haircut (thus creating a method of doing business).

Though the invention has been described with respect to a specific preferred embodiment, many variations and modifications will become apparent to those skilled in the art upon reading the present application. It is therefore the intention that the appended claims be interpreted as broadly as possible in view of the prior art to include all such variations and modifications.

What is claimed is:

1. A hair trimming apparatus comprising:

an elongated handle portion for being held in a hand during a trimming process;

a hair trimming portion having a cutting blade for trimming hair, the hair trimming portion being disposed at one end of the elongated handle portion; and a shell having an upper portion having two sides, and a lower portion having two sides and configured to cover the elongated handle portion; the upper portion and the lower portion forming a body of an airplane;

a first end of the upper portion of the shell adjacent to the hair trimming portion having two upper wings protruding out from both sides of the upper portion;

a second end of the lower portion of the shell adjacent to the hair trimming portion having two lower wings protruding out from both sides of the lower portion;

wherein the upper wings and the lower wings form two wings of the airplane;

a distal end of the upper portion opposite the first end having two small protrusions protruding out from both sides of the upper portion;

a distal end of the lower portion opposite the second end having two small protrusions protruding out from both sides of the lower portion;

wherein the protrusions of the upper portion and the lower portion form two jet blast nozzles of the airplane;

the upper portion further having an opening so that a user can gain access to various controllers of the hair trimming apparatus for operating the hair trimming apparatus.

* * * * *